US006668497B1

(12) United States Patent
Mayer et al.

(10) Patent No.: US 6,668,497 B1
(45) Date of Patent: Dec. 30, 2003

(54) CONCRETE PLACING BOOM ADAPTER

(75) Inventors: Martin G. Mayer, Racine, WI (US); Rodney D. Wurgler, York, ND (US)

(73) Assignee: Putzmeister Inc., Sturtevant, WI (US)

( * ) Notice: Subject to any disclaimer, the term of this patent is extended or adjusted under 35 U.S.C. 154(b) by 126 days.

(21) Appl. No.: 09/938,191

(22) Filed: Aug. 23, 2001

(51) Int. Cl.[7] ..... E04B 9/20; B66C 23/18

(52) U.S. Cl. ..... 52/126.1; 52/127.6; 52/730.5; 248/219.2; 212/176

(58) Field of Search ..... 52/126.1, 726.1, 52/745.17, 749.1, 127.6, 125.2, 730.5, 745.05; 285/334.1; 212/175, 179, 176; 403/384, 345, 286; 248/219.2; 135/120.2, 142

(56) References Cited

U.S. PATENT DOCUMENTS

| | | | | | |
|---|---|---|---|---|---|
| 634,008 | A | * | 10/1899 | Lemley | 212/179 |
| 971,686 | A | * | 10/1910 | Michael et al. | 52/730.5 |
| 1,093,868 | A | * | 4/1914 | Leighty | 285/242 |
| 2,203,113 | A | * | 4/1940 | Uecker et al. | 52/745.17 |
| 2,583,072 | A | * | 1/1952 | Wilson | 52/730.5 |
| 3,268,092 | A | * | 8/1966 | Hainer et al. | 212/176 |
| 3,508,731 | A | * | 4/1970 | Jablonski | 248/219.2 |
| 3,942,554 | A | | 3/1976 | Werner et al. | |
| 3,964,512 | A | | 6/1976 | Dumas | |
| 4,061,230 | A | * | 12/1977 | Goss et al. | 212/70 |
| 4,109,681 | A | | 8/1978 | Stahl | |
| 4,184,600 | A | * | 1/1980 | Goss et al. | 212/70 |
| 4,511,048 | A | | 4/1985 | Volakakis et al. | |
| 4,560,074 | A | | 12/1985 | Manning | |
| 5,117,597 | A | * | 6/1992 | Feller | 52/199 |
| 5,427,256 | A | * | 6/1995 | Kleppe | 212/179 |
| 5,445,487 | A | | 8/1995 | Koscinski, Jr. | |
| 5,980,190 | A | | 11/1999 | Takeda | |
| 6,161,769 | A | | 12/2000 | Kircher et al. | |
| 6,226,955 | B1 | * | 5/2001 | Lorrigan | 52/745.05 |
| 6,363,685 | B1 | * | 4/2002 | Kugler | 52/745.05 |

FOREIGN PATENT DOCUMENTS

| | | | | |
|---|---|---|---|---|
| DE | 3314630 | * | 10/1984 | 212/179 |
| JP | 100995 | * | 4/1990 | 212/176 |

OTHER PUBLICATIONS

U.S. patent application Publication No. US 2002/0112441 A1 "Universal Mast Support Frame and Method for Mounting Masts", Bissen, Publication date Aug. 22, 2002.

* cited by examiner

*Primary Examiner*—Lanna Mai
*Assistant Examiner*—Phi Dieu Tran A
(74) *Attorney, Agent, or Firm*—Andrus, Sceales, Starke & Sawall, LLP

(57) ABSTRACT

A support structure for supporting a concrete placing boom above a work site. The support structure includes a support mast having a generally smooth outer surface. The support mast receives an adapter that can be removed from one support mast and attached to another. The adapter includes a mast receiving portion having a pressure coupling for holding the adapter in contact with the outer surface of the mast. The adapter further includes a boom attachment portion that allows the pedestal of the concrete placing boom to be securely attached to the adapter. The adapter includes a central guide pin that is received within a guide opening formed in a top plate of the support mast. The interaction between the guide pin and the central opening on the mast aids in guiding the adapter onto the mast.

10 Claims, 3 Drawing Sheets

CONCRETE PLACING BOOM ADAPTER

BACKGROUND OF THE INVENTION

The present invention relates to a support structure for supporting a concrete placing boom at a work site. More specifically, the present invention relates to a support structure that includes an adapter that is removably attachable to a support mast and receives the concrete placing boom such that a single adapter can be used with multiple support masts.

Currently, concrete placing booms are used at large work sites, such as in the construction of a multi-floored building, for placing concrete in hard to access locations. Typically, the concrete placing boom is mounted to a support structure that extends above the working surface such that concrete can be supplied from above without requiring heavy hoses to be dragged over the deck, reinforcing and post tensioning cables.

In a large work site, multiple support masts or towers are constructed such that the concrete placing boom can be moved from one support tower to the next in order to provide the required coverage area for the structure being created. In currently available support structures for the concrete placing boom, an adapter is integrally formed with each of the towers or support masts. Each adapter is sized to receive a pedestal formed on the concrete placing boom. An overhead crane is used to move the concrete placing boom and pedestal above the adapter until the concrete placing boom can be lowered into contact with the adapter. Once in contact with the adapter integrally formed with the support mast, the pedestal can be secured to the adapter and support mast.

In several currently available support systems, each of the support masts or towers includes its own adapter secured to the tower. Since each adapter is a large and heavy structure, it is possible that several adapters located at each work site are not being used at any given time.

The support masts or towers in the currently available systems include numerous projections used to secure the mast within a concrete floor opening. However, the projections can contact the floor opening and damage the opening when the support mast is moved from one floor to another. Thus, additional care must be taken when moving the prior art support structure from one location to another, which increases the time needed to move the equipment.

Therefore, a need exists for a support structure for a concrete placing boom in which an adapter is removably attachable to each of the support masts or towers positioned at the work site. Further, a need exists for an adapter that can be removed from one of the support masts and attached to another support mast through a simple mounting arrangement. Additionally, a need exists for an adapter that is received upon the support mast and includes a self-aligning feature to ensure the proper connection of the adapter to the support mast. Further, a need exists for a support mast that does not include external projection to decrease the care required to move the support mast between floors of a building being constructed.

SUMMARY OF THE INVENTION

The present invention relates to a support structure for supporting a concrete placing boom above a work site such that the concrete placing boom can supply a flow of concrete to a particular work position. The support structure of the present invention includes a plurality of individual support masts positioned about the work site. Each of the support masts extends above and is supported by a support surface. For example, each support mast can be supported on and by a lower floor of a building being constructed.

Each support mast is a generally cylindrical structure having an outer wall defining a generally hollow interior. The outer wall of the support mast has an outer surface that is generally devoid of any external projections. The smooth outer surface of the support mast allows the mast to be efficiently manufactured and moved longitudinally with respect to an opening formed in the support surface.

The support mast is closed at its top end by a top plate. The top plate of each support mast includes a central guide opening that aids in locating the center of the support mast.

The support structure of the present invention further includes an adapter that is removably mountable to any one of the plurality of support masts positioned around the work site. The adapter includes a boom attachment portion configured to receive the mounting pedestal of the concrete placing boom and a mast receiving portion that is configured to receive the respective support mast. In this manner, the adapter can be removably attached to both the concrete placing boom and the support mast. Thus, only one adapter is required for the entire support structure of the invention.

The boom attachment portion of the adapter includes a top support plate mounted to the top end of the adapter. The top support plate provides the required support for a series of inner and outer lugs. The inner and outer lugs are spaced from each other to receive depending ears formed on the pedestal of the concrete placing boom. When the concrete placing boom is lowered onto the adapter, the ears of the pedestal are positioned between one of the inner lugs and one of the outer lugs and an attachment bolt secures the adapter to the pedestal.

The mast receiving portion of the adapter is defined at its top end by a mast support plate that is positioned within the interior of the adapter. The mast support plate is secured to the inner surface of the cylindrical wall forming the body portion of the adapter. When the adapter is lowered into contact with the mast, the top end of the mast contacts the mast support plate such that the adapter is supported on the mast by the mast support plate.

The mast support plate includes a guide pin that is sized to fit into the mast receiving receptacle. The guide pin includes a tapered lower surface that is sized to be received within the central guide opening formed on the top end of the mast. The interaction between the guide pin and the central guide opening formed in the top plate of the mast aids in guiding the proper alignment between the adapter and the mast.

Once the adapter is positioned on the respective mast, a pressure coupling contained on the mast receiving portion of the adapter is tightened to secure the adapter to the mast. In the preferred embodiment of the invention, the pressure coupling includes a plurality of adjustment screws that can be tightened into contact with the outer surface of the mast. Preferably, a strengthening plate is mounted within the mast and aligned with the contact points between the pressure coupling and the masts. In this manner, the strengthening plate provides further support for the outer wall of the mast.

The removable adapter of the present invention allows the adapter to be removed from one support mast and reinstalled on a second support mast. Thus, only a single adapter is required for a work site having multiple support masts. Since the adapter is a substantial structure, the inclusion of only one adapter in the support structure of the invention significantly reduces the cost of the overall system.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figures 1, 2:
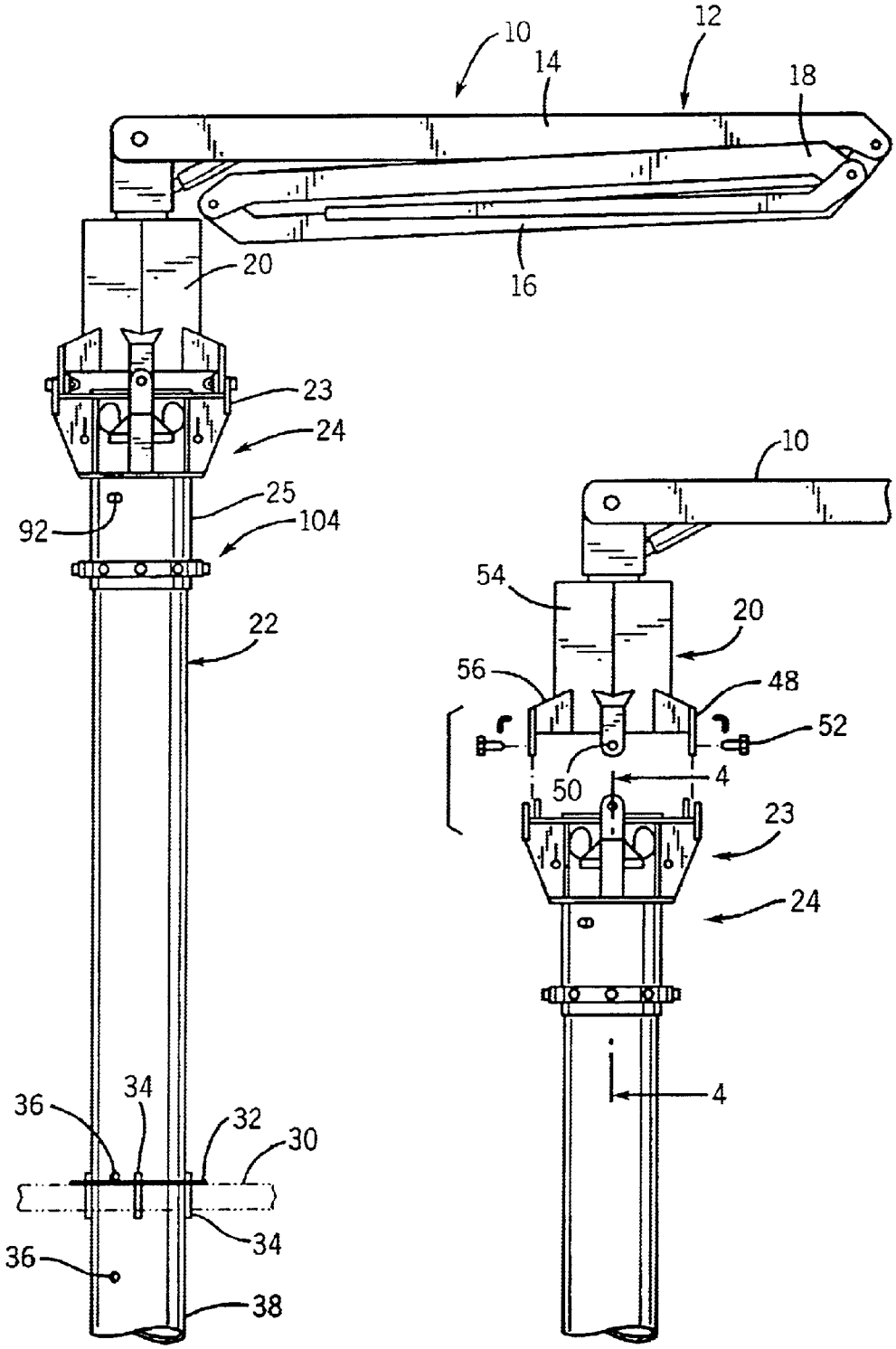
FIG. 1 is a side view of the concrete placing boom and support structure for supporting boom on a support mast.
FIG. 2 is a side view illustrating the removal of the concrete placing boom and pedestal froze adapter that is connected to the support mast.

Referring first to FIG. 1, there is shown a concrete placing boom 10 that is used to deliver a supply of concrete to a remote location. The concrete placing boom 10 includes a boom arm 12 consisting of four separate sections 14, 16 and 18. The boom arm 12 is rotatable about a pedestal 20 and can be raised, lowered and extended to adjust the delivery point of concrete. In the preferred embodiment of the invention, the concrete placing boom is available from Putzmeister America of Sturtevant, Wis., as Model No. MXR 34/38. The concrete placing boom 10 has a horizontal reach of approximately 111 feet from the pedestal 20.

In the embodiment of the invention illustrated in FIG. 1, the concrete placing boom 10 has a weight of approximately 6.5 tons, while the pedestal 20 weighs approximately 2.5 tons. Thus, the combined concrete placing boom 10 and pedestal 20 have a total weight close to 9 tons. Because of this weight, the concrete placing boom 10 and pedestal 20 must be securely supported at a desired location at a work site and can only be moved by heavy lifting equipment.

As illustrated in FIG. 1, the concrete placing boom 10 and pedestal 20 are mounted to a support mast 22 by an adapter 24. As will be discussed in greater detail below, the adapter 24 includes a boom attachment portion 23 and a mast receiving portion 25 that allow the adapter to be removably attachable to both the support mast 22 and the pedestal 20. Although not shown in the drawings, multiple support masts 22 can be positioned about a work site and the concrete placing boom 10 and adapter 24 can be transferred between the plurality of support masts 22 in order to provide the required coverage for the concrete structure being formed.

Figure 3:
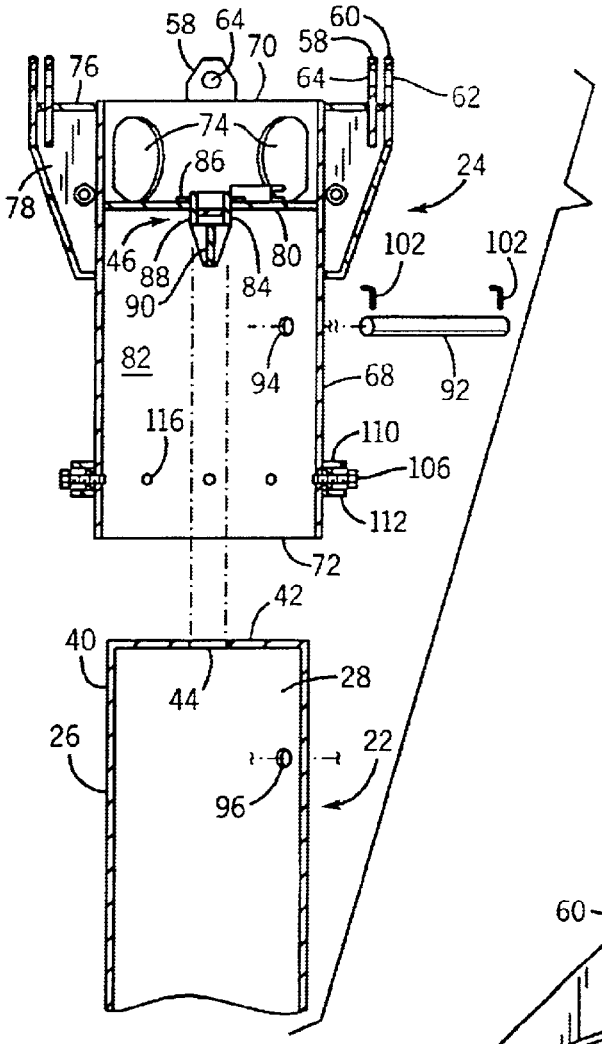
FIG. 3 is a section view illustrating the removal of the adapter from the support mast.

As can be seen in FIGS. 1 and 3, the support mast 22 is formed by a cylindrical outer wall 26 that defines a generally hollow open interior 28. In the embodiment of the invention illustrated, the outer wall 26 defines a cylinder having an outer diameter of approximately 81 centimeters.

As illustrated in FIG. 1, the support mast 22 is supported on a floor slab 30 by a floor bracket 32 and a plurality of individual wedges 34. In the preferred embodiment of the invention, the mast 22 includes a plurality of locking apertures 36 that are formed near the bottom end 38 of the support mast. The locking apertures 36 are each sized to receive a cross pin (not shown) that engages the floor bracket 32. The combination of the floor bracket 32 and the cross pin passing through the locking aperture 36 supports the mast 22 along the floor slab 30.

In the preferred embodiment of the invention illustrated, the floor slab 30 has an opening slightly larger than the outer diameter of the support mast 22. However, since the support mast 22 has a smooth outer surface over its entire length, the support mast 22 can be easily raised and lowered through the concrete floor opening formed in the floor slab 30. In previously available support structures for a concrete placing boom, the support mast included external projections that increased the difficulty in sliding the mast upward and downward through the concrete floor opening. Specifically, additional care was required to prevent damage to the concrete floor and the shaft itself. The support mast 22 illustrated in FIG. 1 is devoid of such projections, which allows the support mast to easily pass through such floor openings.

In the preferred embodiment of the invention, the support mast 22 has a length of approximately 12 meters. The length of the support mast 22 allows the concrete placing boom 10 to be located a sufficient height above the floor slab 30, since concrete is often being placed at a level slightly above the floor slab 30. Although not illustrated in the Figures, it is contemplated that the floor mast sections can be joined together such that the concrete placing boom 10 can be located higher above the floor slab 30. In the preferred embodiment of the invention, the support mast 22 is formed from steel and has a weight of approximately 3,300 kilograms.

Referring now to FIG. 3, the top end 40 of the support mast 22 includes a top plate 42. The top plate 42 is securely connected to the cylindrical outer wall 26 and closes the top end 40 of the support mast 22. As illustrated in FIG. 3, the top plate 42 includes central guide opening 44 formed in the top plate 42. The central guide opening 44 is centered along the longitudinal axis of the support mast 22 and has a diameter of approximately 15 cm. As will be described in greater detail below, the central guide opening 44 receives a guide pin 46 formed on the adapter 24.

Referring now to FIG. 2, the pedestal 20 that is attached to the concrete placing boom 10 includes a plurality of depending ears 48 that are used to secure the pedestal 28 to the adapter 24. Each of the ears 48 includes an opening 50 sized to receive an attachment pin 52. As can be seen in FIG. 2, each of the ears 48 is attached to the pedestal base 54 by a support flange 56. Each of the support flanges 56 are welded to the base 54.

Figure 5:
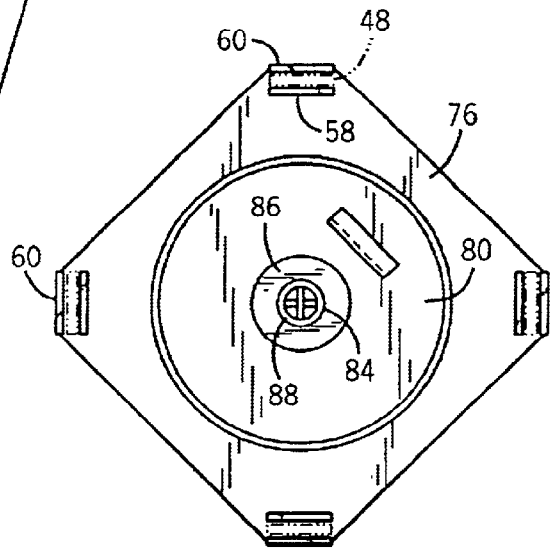
FIG. 5 is a top view taken along line 5—5 of FIG. 4 illustrating the top support plate of the adapter.
Figure 4:
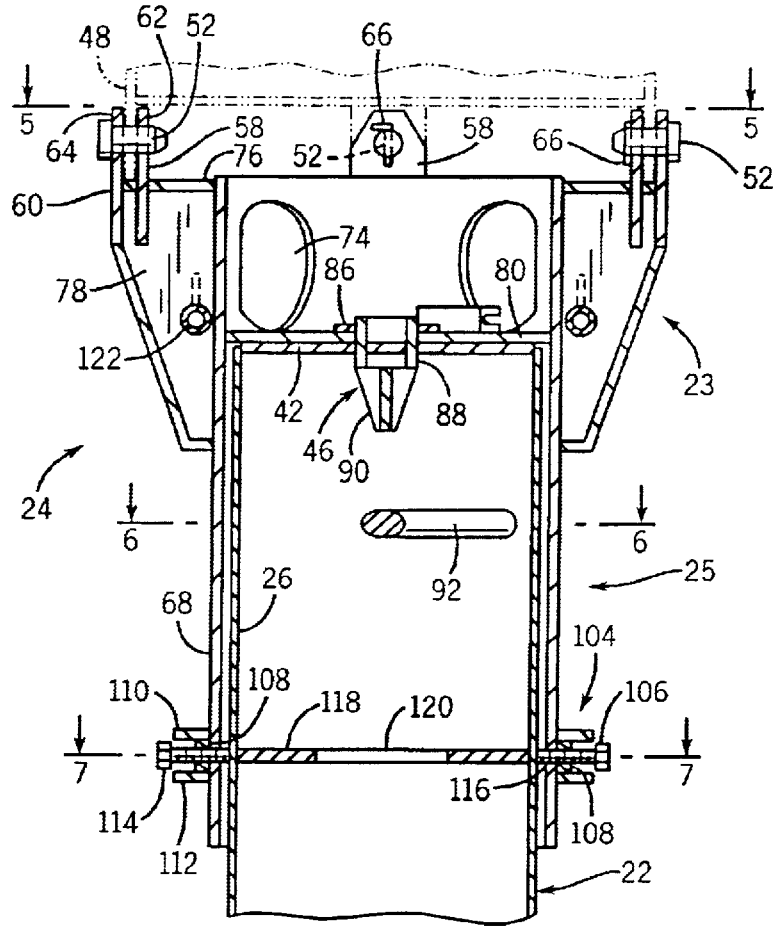
FIG. 4 is a section view taken along line 4—4 of FIG. 2 illustrating the interconnection between e adapter and support mast of the support structure of the invention.

As the concrete placing boom, including the pedestal 20, are lowered into contact with the boom attachment portion 23 of the adapter 24, each of the ears 48 is received between an inner lug 58 and an outer lug 60, as illustrated in FIG. 4. As illustrated in FIGS. 4 and 5, the inner lug 58 and the outer lug 60 are spaced by a distance sufficient to receive the ear 48 formed on the pedestal 20. Each of the inner lugs 58 and the outer lugs 60 include an opening 62 and 64 that are each sized to receive one of the pins 52. As shown in FIG. 4, the pins 52 are able to secure the pedestal 20 to the adapter 24. Each of the pins 52 receives a cotter pin 66 to ensure that the pin 52 does not inadvertently become disassociated with the adapter and pedestal.

Referring now to FIGS. 3 and 5, the adapter 24 is defined by a cylindrical outer wall 68 that extends between a top end 70 and a bottom end 72. In the preferred embodiment of the invention, the adapter 24 has an overall height from the top end 70 to the bottom end 72 of approximately 184 cm and is formed from steel. The outer wall 68 includes a series of openings 74 that provide access for the concrete delivery lines for the placing boom 10. Specifically, the delivery lines extend through the open interior of the pedestal and exit through the openings 74 and are connected to the placing boom 10.

As illustrated in FIGS. 3 and 5, the boom attachment portion of the adapter 24 includes a top support plate 76 that is welded to the top end 70 of the outer wall 68. The top support plate 76 is diamond shaped with each of its corners defined by one of the outer lugs 60. The top support plate 76 is generally horizontal and supported by a series of support flanges 78 that are each attached at their upper ends to the top support plate 76 and are attached at their inner end to the outer wall 68 of the adapter 24. The support flanges 78 aid in supporting the weight of the pedestal 20 and the concrete placing boom 10, as best illustrated in FIG. 1.

Referring back to FIG. 3, the adapter 24 includes a mast support plate 80 mounted within the open interior of the adapter 24 defined by the outer wall 68. The mast support plate 80 defines the top end of a mast receiving receptacle 82. The mast receiving receptacle 82 is defined by the outer wall 68 and the mast support plate 80.

As can be seen in FIG. 3, the mast support plate 80 includes a central opening 84 sized to receive the guide pin 46. The guide pin 46 includes a radial outer flange 86 that contacts the top surface of the mast support plate 80 to prevent the guide pin 46 from passing completely through the central opening 84. The outer flange 86 is welded to the mast support plate 80 to hold the guide pin 46 in place. The guide pin 46 generally includes a cylindrical body portion 88 and a tapered tip portion 90. The tapered tip portion 90 decreases in diameter from a widest point of 15.2 cm to a narrowest portion of 5 cm.

During the initial installation of the adapter 24 onto the support mast 22, the top end 40 of the support mast is initially received within the mast receiving receptacle 82 of the adapter 24. As the adapter 24 continues to move downward, the guide pin 46 comes into contact with the top plate 42 formed on the mast 22. Specifically, the tapered tip portion 90 of the guide pin 46 enters into the central guide opening 44 formed in the top plate 42. Since the guide pin 46 is tapered, the guide pin 46 aids in creating the proper alignment between the adapter 24 and the support mast 22.

The adapter 24 continues to be lowered until the top plate 42 of the support mast 22 contacts the mast support plate 80 of the adapter 24. Once these two elements are in contact with each other, the weight of the adapter 24 is completely supported by the mast 22.

Figure 6:
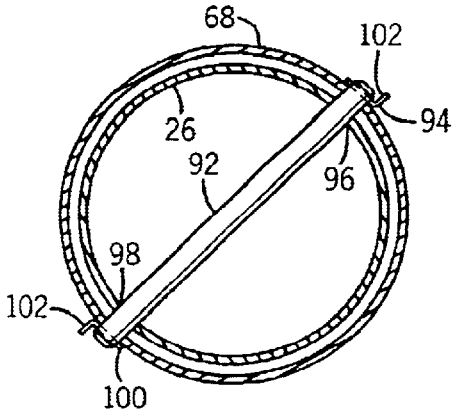
FIG. 6 is a section view taken along line 6—6 of FIG. 4.

After the adapter 24 is in position, a cross pin 92 is inserted through a cross pin opening 94 in the outer wall 68 of the adapter 24. The cross pin 92 further passes through an aligned cross pin opening 96 formed in the outer wall 26 of the mast 22. As shown in FIG. 6, the cross pin 92 passes through a second cross pin opening 98 formed in the mast outer wall 26 and a second cross pin opening 100 formed in the adapter outer wall 68. As illustrated, the first and second cross pin openings formed in the adapter 24 and the support mast 22 are positioned 180° from each other to permit the cross pin 92 to pass through the two elements. Each end of the cross pin 92 receives a cotter pin 102 to secure the cross pin 92 between the adapter 24 and the mast 22.

Once the adapter 24 has been positioned on the support mast 26, a pressure coupling 104 contained on the mast receiving portion 25 of the adapter 24 is used to secure the adapter 24 to the mast 26, as shown in FIG. 4. In the preferred embodiment of the invention, the pressure coupling 104 includes a plurality of pressure screws 106 that are each received within a threaded nut 108 in contact with the outer surface of the outer wall 68 of the adapter 24. Each of the screws 106 includes an external thread that interacts with an internal thread formed in the nut 106. Thus, as the screw 106 is rotated, the inner end 110 of the screw 106 moves into contact with the outer surface of the outer wall 26 of the support mast 22. As can be understood in FIG. 7, the outer diameter of the support mast 22 is less than the inner diameter of the outer wall 68 of the adapter 24. Thus, tightening each of the eight screws 106 spaced equally around the outer circumference of the adapter 24 locks the adapter 24 into contact with the support mast 22.

Figure 7:
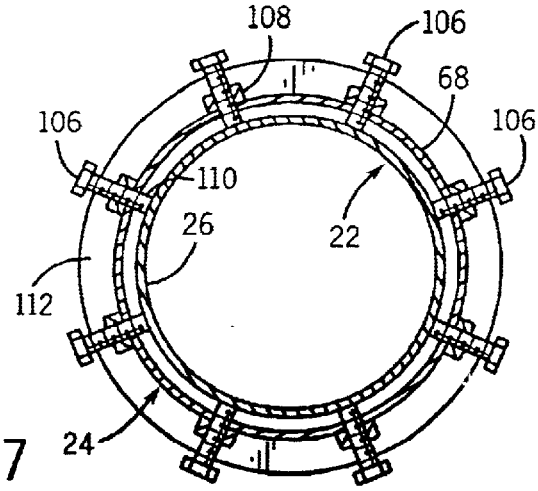
FIG. 7 is a section view taken along line 7—7 illustrating the pressure coupling between the adapter and support mast.

As can be seen in FIGS. 4 and 7, each of the nuts 108 is entrapped between a top plate 110 and a bottom plate 112 that define a channel 114 around the outer circumference of the adapter 24. As can be understood in FIG. 7, the channel 114, and thus each of the nuts 108, are aligned with a series of openings 116 formed in the adapter 24 to allow the screws 106 to press into contact with the mast 22.

In the embodiment of the invention illustrated in FIG. 4, a strengthening plate 118 is connected across the open interior of the support mast 22. The strengthening plate 118 is aligned with the points of contact between each of the screws 106 and the outer wall 26 of the mast to provide additional support for the tubular outer wall 26. The strengthening plate 118 includes a central opening 120 to reduce the overall weight of the plate.

Although not illustrated in the Figures, a work platform can be supported beneath the adapter 24 to allow persons to stand underneath the concrete placing boom 10. Specifically, a work platform is supported by support rods 122 that pass through each of the support flanges 78. Since the work platform is associated with the adapter 24, only a single work platform is needed at a work site. For example, when the adapter 24 is moved from one mast to another, the work platform can be moved along with the adapter.

Various alternatives and embodiments are contemplated as being within the scope of the following claims particularly pointing out and distinctly claiming the subject matter regarded as the invention.

We claim:

1. A support structure for supporting a concrete placing boom above a work site, the concrete placing boom including an extendable boom arm for placing concrete at a location remote from the support structure, the concrete placing boom including a mounting pedestal used to support the boom arm, the support structure comprising:

a support mast supported on and extending upwardly from a support surface, the support mast having an outer wall defining a generally hollow interior;

an adapter removably attachable to the support mast, the adapter having a boom attachment portion for receiving the mounting pedestal of the concrete placing boom and a mast receiving portion for receiving the support mast, wherein the mast receiving portion includes a mast receiving receptacle defined by a cylindrical outer wall, the mast receiving receptacle being sized to receive a top end of the mast, wherein the adapter includes a mast supporting plate positioned to define a top end of the mast receiving receptacle, the mast supporting plate contacting the top end of the mast to support the adapter on the mast; and a central guide pin extending from the mast support plate, wherein the central guide pin is received in a central guide opening formed in the top end of the mast and wherein the guide pin includes a tapered lower surface that is receivable in the central guide opening formed in the top end of the mast.

2. The support structure of claim 1 wherein the support mast includes a smooth cylindrical outer surface generally devoid of external projections.

3. The support structure of claim 1 wherein the adapter includes a pressure coupling for holding the adapter in contact with the outer surface of the mast.

4. The support structure of claim 1 further comprising a pressure coupling formed on the mast receiving portion for holding the adapter in contact with the outer surface of the mast.

5. The support structure of claim 4 wherein the pressure coupling includes a plurality of adjustable screws each passing through the outer wall of the mast receiving receptacle and movable into contact with the outer surface of the support mast.

6. The support structure of claim 1 wherein the adapter includes a top support plate attached to the outer wall of the adapter, the top support plate including a plurality of attachment ears that receive corresponding lugs formed on the mounting pedestal.

7. A support structure for supporting a concrete placing boom above a work site, the concrete placing boom including an extendable boom arm for placing concrete at a location remote from the support structure, the concrete placing boom including a mounting pedestal used to support the boom arm, the support structure comprising:

a plurality of support masts each supported on and extending upwardly from a support surface, the plurality of support masts being spaced about the work site, each support mast having a cylindrical outer wall defining a generally hollow interior, the cylindrical outer wall being generally devoid of external projections;

a single adapter removably attachable to each of the support masts, the adapter having a boom attachment portion for receiving the mounting pedestal of the concrete placing boom and a mast receiving portion for receiving one of the support masts, wherein the adapter can be moved between the plurality of support masts, wherein the mast receiving portion includes a mast receiving receptacle defined by a cylindrical outer wall, the mast receiving receptacle being sized to receive a top end of each of the support masts, wherein the adapter includes a mast supporting plate positioned to define a top end of the mast receiving receptacle, the mast supporting plate contacting the top end of the mast to which the adapter is mounted to support the adapter on the mast; and a central guide pin extending from the mast support plate, wherein the central guide pin is received in a central guide opening formed in the top end of each of the masts, and wherein the guide pin includes a tapered lower surface that is receivable in the central guide opening formed in the top end of each of the masts.

8. The support structure of claim 7 further comprising a pressure coupling formed on the mast receiving portion for holding the adapter in contact with the outer surface of the mast to which the adapter is mounted.

9. The support structure of claim 8 wherein the pressure coupling includes a plurality of adjustable screws each passing through the outer wall of the mast receiving receptacle, wherein the adjustable screws are each movable into contact with the outer surface of the support mast.

10. A support structure for supporting a concrete placing boom above a work site, the concrete placing boom including an extendable boom arm for placing concrete at a location remote from the support structure, the concrete placing boom including a mounting pedestal used to support the boom arm, the support structure comprising:

a plurality of support masts each supported on and extending upwardly from a support surface, the plurality of support masts being spaced about the work site, each support mast having a cylindrical outer wall defining a generally hollow interior, the cylindrical outer wall being generally devoid of external projections;

a single adapter removably attachable to each of the support masts, the adapter having a boom attachment portion for receiving one of the support masts, wherein the adapter can be moved between the plurality of support masts, wherein the mast receiving portion includes a mast receiving receptacle defined by a cylindrical outer wall, the mast receiving receptacle being sized to receive a top end of each of the support masts;

a pressure coupling formed on the mast receiving portion for holding the adapter in contact with the outer surface of the mast to which the adapter is mounted, wherein the pressure coupling includes a plurality of adjustable screws each passing through the outer wall of the mast receiving receptacle, wherein the adjustable screws are each movable into contact with the outer surface of the support mast; and a strengthening plate formed on the interior of each support mast, the strengthening plate being aligned with the pressure coupling of the adapter when the adapter is attached to the mast.

* * * * *